US009119005B2

(12) United States Patent
Fuertes, III

(10) Patent No.: US 9,119,005 B2
(45) Date of Patent: Aug. 25, 2015

(54) CONNECTION DIAGNOSTICS FOR PARALLEL SPEAKERS

(71) Applicant: Bose Corporation, Framingham, MA (US)

(72) Inventor: Steven Anthony Fuertes, III, Somerville, MA (US)

(73) Assignee: Bose Corporation, Framingham, MA (US)

( * ) Notice: Subject to any disclaimer, the term of this patent is extended or adjusted under 35 U.S.C. 154(b) by 268 days.

(21) Appl. No.: 13/860,941

(22) Filed: Apr. 11, 2013

(65) Prior Publication Data

US 2014/0307881 A1 Oct. 16, 2014

(51) Int. Cl.

| | |
|---|---|
| ***H04R 29/00*** | (2006.01) |
| ***H04R 5/04*** | (2006.01) |
| *H04R 3/12* | (2006.01) |

(52) U.S. Cl.

CPC ..... *H04R 29/001* (2013.01); *H04R 5/04* (2013.01); *H04R 3/12* (2013.01); *H04R 2420/05* (2013.01)

(58) Field of Classification Search

CPC .. H04R 2420/05; H04R 29/00; H04R 29/001; H04R 3/12; H04R 5/04

USPC ..... 381/24, 58, 59, 300

See application file for complete search history.

(56) References Cited

U.S. PATENT DOCUMENTS

| | | | | |
|---|---|---|---|---|
| 4,061,891 | A * | 12/1977 | Pommer | 381/58 |
| 4,580,091 | A * | 4/1986 | Robinson et al. | 324/555 |
| 5,450,624 | A * | 9/1995 | Porambo et al. | 455/226.4 |
| 7,039,201 | B1 * | 5/2006 | Lee et al. | 381/97 |
| 2006/0023898 | A1 * | 2/2006 | Katz | 381/98 |
| 2010/0019781 | A1 * | 1/2010 | Woelfl et al. | 324/691 |
| 2013/0170659 | A1 * | 7/2013 | Guanziroli et al. | 381/59 |

FOREIGN PATENT DOCUMENTS

EP 2229006 A1 * 9/2010

OTHER PUBLICATIONS

International Search Report and Written Opinion dated Jul. 17, 2014 for International application No. PCT/US2014/031738.

* cited by examiner

*Primary Examiner* — Khai N Nguyen

(57) ABSTRACT

Connectivity of a pair of parallel electroacoustic transducers is determined by applying a first test signal on the output line at a frequency where the impedance of the transducers in parallel is less than the impedance of the higher-frequency transducer alone, and observing whether a clip signal is received. If the clip signal is not received, an error indication is output. A second test signal is applied at a frequency where the impedance of the transducers in parallel is less than the impedance of the lower-frequency transducer alone. If the clip signal is not received, the error indication is output. A third test signal is applied at a frequency where the impedance of the transducers in parallel is higher if both transducers are operational than if the higher-frequency transducer is internally short-circuited. If the clip signal is received, a third error indication is output.

14 Claims, 4 Drawing Sheets

CONNECTION DIAGNOSTICS FOR PARALLEL SPEAKERS

BACKGROUND

This disclosure relates to connection diagnostics for parallel speakers.

Conventional automotive audio systems are equipped with circuits that test the connection state of the connected electroacoustic transducers, i.e., speakers, in the system. Such systems typically apply a current and measure whether the impedance on the line is above or below a threshold indicative of the presence of the intended speaker. If the speaker is missing, the impedance will be too high. If the speaker connection is short circuited, the impedance will be too low. These techniques can also detect whether either of the conductors going to the speaker is shorted to power or to ground.

It is also typical in automotive audio systems to connect two speakers, such as a mid-range speaker or woofer, and a tweeter, in a parallel configuration on a single output line of an amplifier. A woofer will reproduce low-frequency components of a broadband audio signal, the tweeter will reproduce the high-frequency components of the same total signal, and a mid-range speaker will reproduce signals in-between the ranges of the woofer and tweeter. Typically, one or the other of a woofer and a mid-range speaker will be paired with a tweeter in the sorts of systems discussed herein. Note that by "woofer," "mid-range," and "tweeter" we refer simply to any two speakers suited to two different bands of audio, without intending to specify any particular crossover frequency. The diagnostic techniques mentioned above, as currently employed, cannot accurately determine the connectivity of both speakers in a pair of speakers connected in parallel.

SUMMARY

In general, in one aspect, connectivity of a pair of electroacoustic transducers including a higher-frequency transducer and a lower-frequency transducer and connected in parallel on an output line of an amplifier, is determined by applying a first test signal on the output line at a first test frequency where the impedance of the two transducers in parallel is less than the impedance of the higher-frequency transducer alone, and observing whether a first clip detection signal is received from the amplifier. If the first clip detection signal is not received from the amplifier in response to the first test signal, a first error indication is output and the test is stopped. If the first clip detection signal is received from the amplifier in response to the first test signal, a second test signal is applied on the output line at a second test frequency where the impedance of the two transducers in parallel is less than the impedance of the lower-frequency transducer alone. If a second clip detection signal is not received from the amplifier in response to the second test signal, a second error indication is output.

Implementations may include one or more of the following. If the second clip detection signal is received from the amplifier in response to the second test signal, a third test signal may be applied on the output line at a third test frequency where the impedance of the two transducers in parallel is higher if both transducers are operational than if the high-frequency transducer is internally short-circuited, and if a third clip detection signal is received from the amplifier in response to the third test signal, a third error indication would be output. The first test signal may be output at a level sufficient to cause the amplifier to clip at the first test frequency if the lower-frequency transducer is connected to the output line. The second test signal may be output at a level sufficient to cause the amplifier to clip at the second test frequency if the higher-frequency transducer is connected to the output line. The third test signal may be output at a level sufficient to cause the amplifier to clip at the third test frequency if the higher-frequency transducer is not internally short-circuited, but not sufficient to cause the amplifier to clip at the third test frequency if both transducers are operational. The third test frequency may be the same as the second test frequency, and the level of the third test signal would be different from a level of the second test signal. Outputting the first error indication and outputting the second error indication may both involve outputting a generic error signal. Outputting the first, second, and third error indications may involve outputting a generic error signal.

In general, in one aspect, an audio system is capable of determining connectivity of a pair of electroacoustic transducers including a higher-frequency transducer and a lower-frequency transducer and connected in parallel on an output line of the audio system. The audio system includes an amplifier circuit including a clip-detection circuit and configured to provide amplified signals to the output line, and a controller coupled to the amplifier circuit and configured to cause the amplifier circuit to apply a first test signal on the output line at a first test frequency where the impedance of the two transducers in parallel is less than the impedance of the higher-frequency transducer alone, determine whether a first clip detection signal was generated by the amplifier circuit, and, if a clip detection signal is not generated by the amplifier circuit in response to the first test signal, output a first error indication and stop. If a clip detection signal is generated by the amplifier circuit in response to the first test signal, the controller will cause the amplifier circuit to apply a second test signal on the output line at a second test frequency where the impedance of the two transducers in parallel is less than the impedance of the lower-frequency transducer alone, determine whether a second clip detection signal was generated by the amplifier circuit, and, if a clip detection signal is not generated by the amplifier circuit in response to the second test signal, output a second error indication.

All examples and features mentioned above can be combined in any technically possible way. Other features and advantages will be apparent from the description and the claims.

DESCRIPTION

Figure 1:
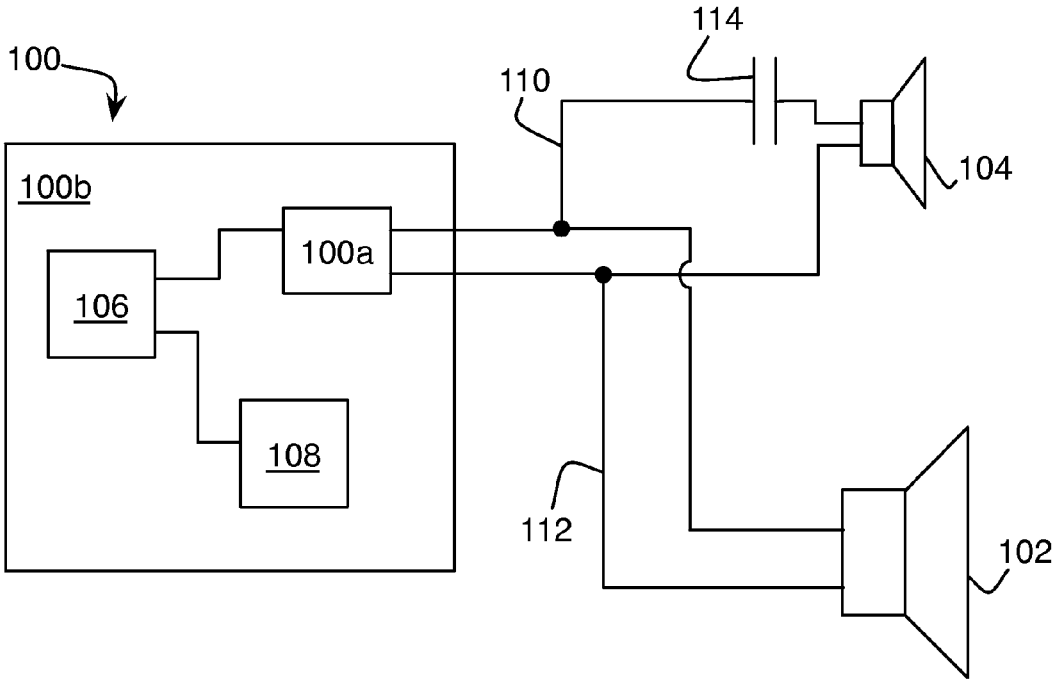
FIG. 1 shows a schematic diagram of an amplifier connected to two speakers on a single output channel.

As shown in FIG. 1, the type of audio system discussed below includes three principle components: an amplifier 100, a first speaker 102, and a second speaker 104. The speakers receive amplified audio signals from the amplifier over signal lines 110 and 112. Additional speakers are connected similarly. Typically, the first speaker will be a mid-range speaker or a woofer, and the second speaker will be a tweeter, that is, a speaker suited to reproducing high-frequency sounds. Tweeter 104 typically includes a capacitor 114 to serve as a high-pass filter on the signals reaching the tweeter. The function of amplifying signals and outputting them to the speakers is typically provided by an integrated circuit component referred to as an amplifier integrated circuit (IC) 100*a*, which is part of a larger assembly 100*b*, also typically called an "amplifier." The diagnostic techniques discussed may be provided by the amplifier IC, or by other components within the larger amplifier assembly.

The amplifier may include a microprocessor or microcontroller 106 capable of performing the tests described herein and interpreting results, or this may be controlled in part by an external device controlling the amplifier. Program code for the microprocessor 106, including test parameters, may be stored in a memory 108. For the purposes of this discussion, we use "amplifier" generically to refer to whatever device is providing signals to the transducers, regardless of what technology or architecture is used. The amplifier may be a part of another component, such as a multimedia system head unit, or it may be a stand alone device in the vehicle.

Automotive audio systems need to be able to diagnose (and report) the connection state of the speakers, as mentioned above. Standard techniques can determine whether either of the signal lines is shorted to ground, to battery, or to the other line, regardless of how many speakers are present. In some applications, it is not necessary to distinguish between which of the speakers is at fault, as any repair procedure will check both. However, even where the only information needed is whether or not both speakers are correctly installed, each of the speakers present on the line complicates detecting whether the other speaker is responding correctly. Standard techniques cannot tell whether one speaker is missing when the other is present, and they cannot tell if a tweeter which includes a capacitor to act as a high-pass filter is shorted internally. That is, a frequency at which a test signal would indicate that neither speaker is short circuited across the signal lines (because the impedance of the circuit is above a threshold for both speakers) would not distinguish between both speakers being present and one speaker being missing (because, at such a frequency, the additional impedance of the tweeter is within the variability of the woofer, and vice-versa).

Figure 2:
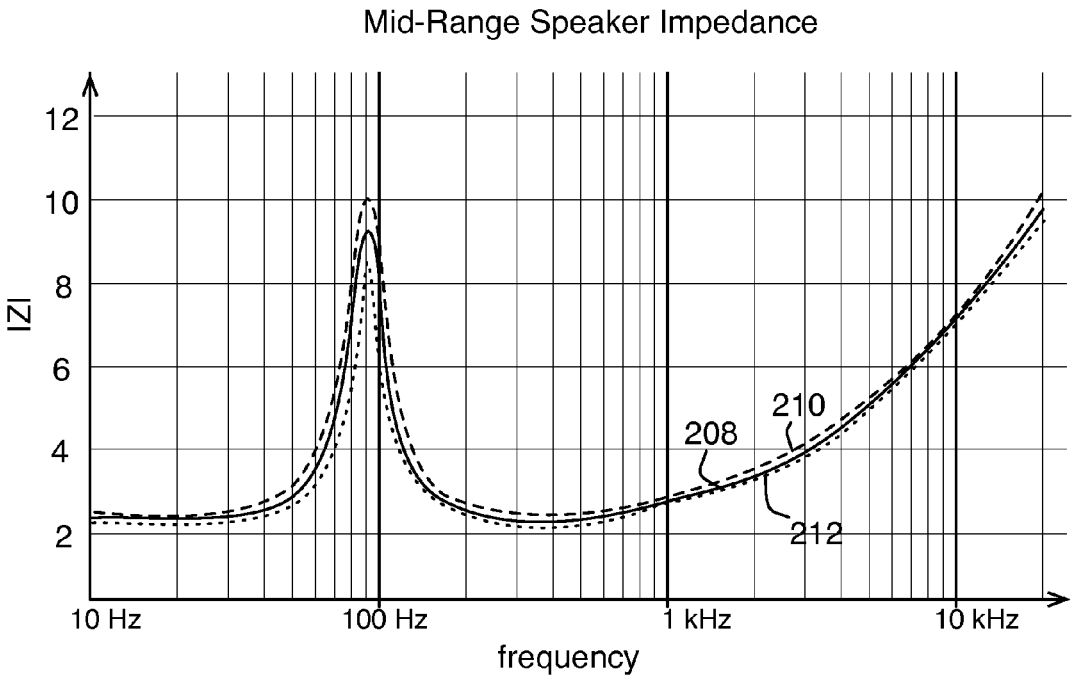
FIG. 2 shows a graph of the impedance of a mid-range speaker as a function of frequency.
Figure 3:
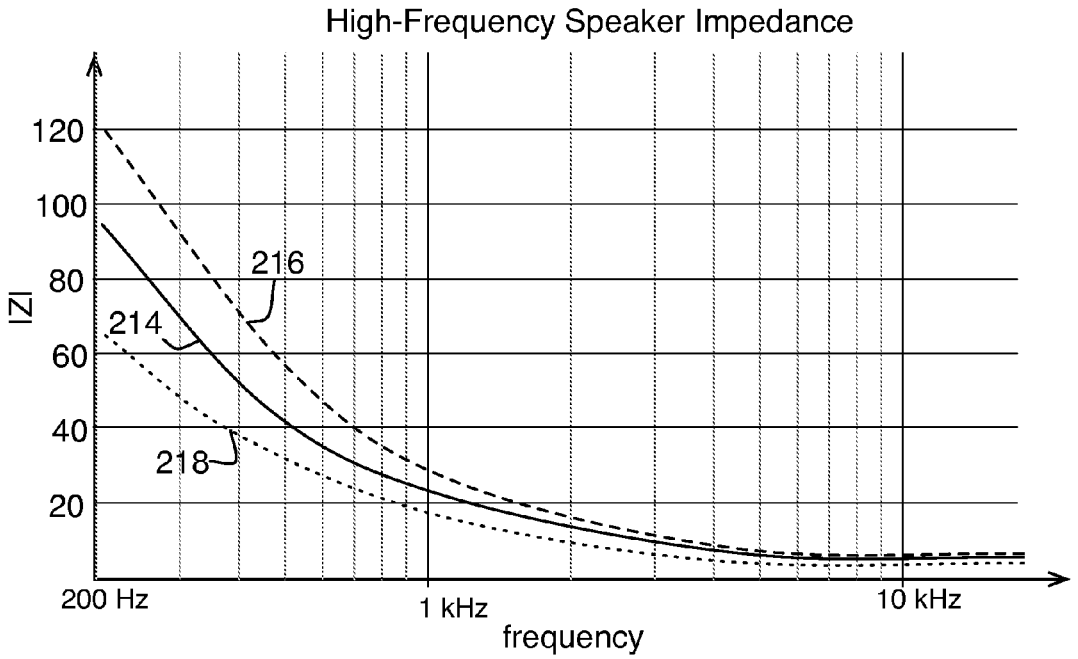
FIG. 3 shows a graph of the impedance of a high-frequency speaker as a function of frequency.
Figure 4:
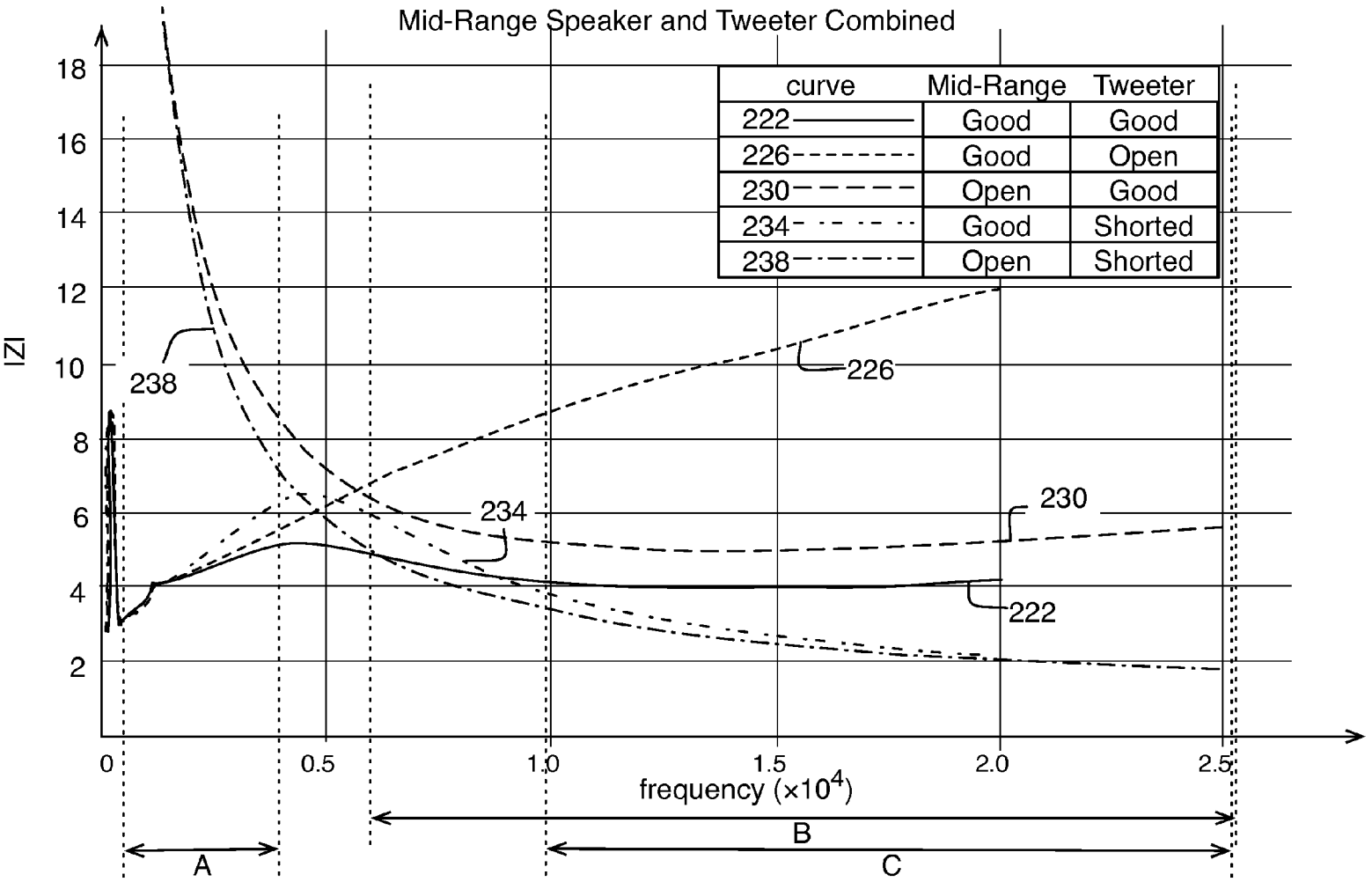
FIG. 4 shows a graph of the combined impedance as a function of frequency of the speakers of FIGS. 2 and 3, including several failure modes.

To resolve this difficulty, additional tests are performed. To explain these tests, reference is made to FIGS. 2 through 4. FIG. 2 shows the impedance as a function of frequency for a typical mid-range speaker used in automotive applications. FIG. 3 shows the same values for a typical tweeter. In each graph, three curves are shown. The solid middle curves 208, 214 show the mean impedance from a sample of 100 speakers. The dashed upper curves 210, 216 and dotted lower curves 212, 218 show the outer limits of variability of the sample, defined as three standard deviations (three sigma) from the mean in each direction. FIG. 4 shows the combined impedance on a circuit having the mid-range speaker from FIG. 2, and the tweeter from FIG. 3. A Solid line 222 shows the expected impedance, while the other lines show various failure modes. Line 226, having short dashes, shows the impedance when the tweeter is absent, so only the mid-range speaker is present. Line 230, having long dashes, shows the impedance when the mid-range speaker is absent, so only the tweeter is present. Line 234, having short dashes and dots, shows the response when both speakers are present but the tweeter is internally shorted. Line 238, having long dashes and dots, shows the impedance when the mid-range speaker is missing and the tweeter is present but internally shorted. Note the difference in axes between the graphs—FIGS. 2 and 3 use a log scale on the frequency axis, while FIG. 4 uses a linear scale, greatly compressing the low frequencies and expanding the high frequencies relative to what is shown in the individual speaker graphs. This is done because the most critical region for the tests described below is in the upper frequencies.

To detect problems with the connection of only one speaker, referring again to FIG. 1, the amplifier 100 applies a series of test signals across the output lines 110, 112 and uses a clip detection feature of the amplifier IC 100*a* to explore whether the correct load is observed. To provide the clip detection feature, the amplifier IC 100*a* measures the current being drawn by its load. When a given voltage is applied across the output lines, the impedance across the lines will determine what current is drawn. If the impedance is too low, too much current will be drawn (per Ohm's law, $V=I\times R$). The amplifier IC provides a "clip detect" signal on a diagnostic output if the current it measures is above a threshold based on the performance capabilities of both the speakers and the amplifier.

To find the test frequencies, we refer again to FIG. 4. First, a frequency is selected at which the highest possible combined impedance of the speakers, even if the tweeter is internally shorted (i.e., lines 222 and 234), is below the lowest impedance that could be seen if the mid-range speaker is missing and the tweeter is present (lines 230 and 238). The area where this condition is met is marked as zone A in FIG. 4. A signal is applied at the selected frequency at an amplitude that will cause the amplifier to clip if the mid-range speaker is present (due to the low combined impedance) but would not cause clipping if the tweeter is present alone (due to the high low-frequency impedance of the tweeter and its protection capacitor). If a clip-detect signal is received from the amplifier IC, it is known that the mid-range speaker is present, but the presence of the tweeter remains unknown.

A second test detects whether the tweeter is absent from the line. For this test, a frequency and signal level are selected where the impedance with the tweeter missing (line 226) is higher than the impedance with both speakers present (lines 222 and 234). The area where this condition is met is marked as zone B in FIG. 4. This may be done at high frequencies, where the mid-range transducer impedance greatly increases (line 226, and per FIG. 2), making it much higher than the impedance of the tweeter. The chosen level is high enough to cause clipping if both speakers are present (lines 222 and 234) but will not cause clipping if the tweeter is missing, due to the higher impedance of the mid-range speaker alone. This level may also cause clipping if the mid-range speaker is absent (line 230), given the low impedance of the tweeter at high frequencies, but that possibility was eliminated by the first test, so a clip-detect signal from the amplifier IC confirms that the tweeter is present.

Figure 5:
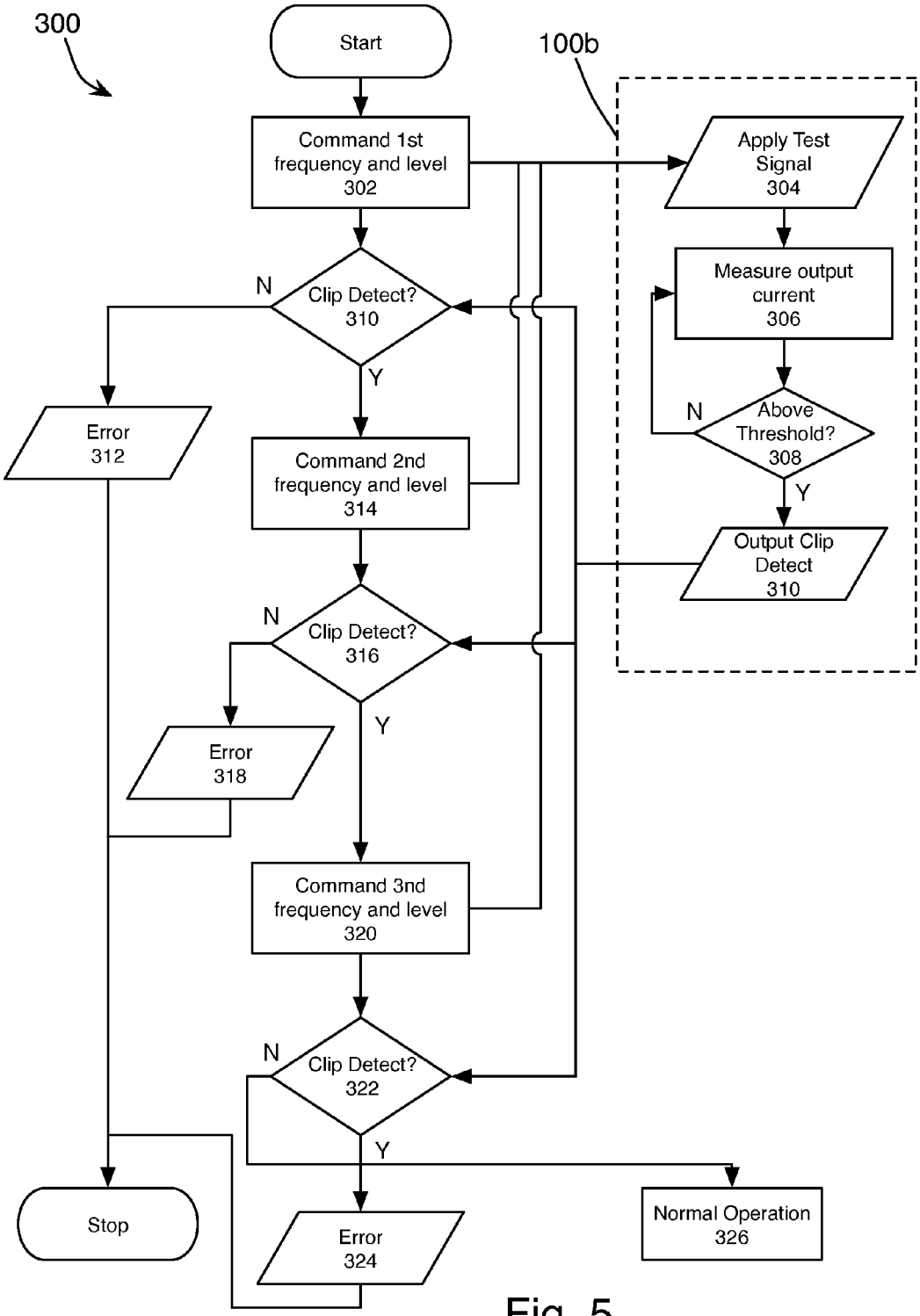
FIG. 5 shows a flow chart of a process for detecting parallel speakers.

Having confirmed that both speakers are present, a third frequency and level are selected at which the impedance due to the tweeter being internally short-circuited (line 238) can be distinguished from the impedance due to both speakers being installed and operational (line 222). At high frequencies, the impedance will be very low if the tweeter is internally shorted, and below the impedance when both speakers are operational, zone C in FIG. 4. The test signal is set to a level that would not cause clipping if both speakers were operational. The test signal is applied, and a lack of a clip-detect signal from the amplifier IC confirms that the tweeter is not internally shorted. Because it has previously been determined that both speakers are at least present, it does not matter that the impedance at this frequency will be high enough to not clip even if one of the speakers is missing (lines 226 and 230). As can be seen from FIG. 5, zones B and C overlap, so the second and third test signals may be the same frequency, but they will be at different levels as they are attempting to cause clipping for different loads.

The process described above is summarized in the flow chart 300 of FIG. 5. In the flowchart, the steps performed by the processor 106 are shown on the left, and the steps performed by the amplifier IC 100*b* are shown on the right inside a dashed box. At a first step 302, the processor sends the first test frequency and level to the amplifier IC, which applies (304) the test signal to the output line. The amplifier IC measures (306) the current it is outputting, and compares it to a threshold (308). If the current is above threshold, the amplifier IC outputs (310) a clip detect signal. If the current is below threshold, it continues operating until a new instruction is received.

Returning to the processor, at step 310, if it receives the clip detect signal, it continues to the next test. If the clip detect signal is not received within a predetermined amount of time, an error output is generated and the process stops. If the clip detect signal was received, the processor sends (314) the second test frequency and level to the amplifier IC, which repeats the steps 304, 306, 308, and 310 with the new signal. At step 316, the processor again generates and error (318) if no clip detect signal is received, or continues to the third test if the clip detect signal is received.

At step 320, the processor sends the third test signal frequency and level to the amplifier IC, which again repeats steps 304, 306, 308, and 310. This time, if the clip detect signal is received (322), the error is generated (324), and if the clip detect signal is not received, it is assumed that the microphones are correctly installed and operational, and normal operation continues (326). The error signals output at steps 312, 318, and 324 may be specific to which test was failed, or any two or all three may all be the same generic error signal.

The particular frequencies at which the tests should be performed, and the amplitudes of the test signals, may be determined empirically, with a sufficiently large sample size, or from the specifications of the speakers. Once a particular pair of speakers is selected for a given system design, their impedance curves and tolerances are compared to identify the first, second, and third test frequencies and signal levels.

A number of implementations have been described. Nevertheless, it will be understood that additional modifications may be made without departing from the scope of the inventive concepts described herein, and, accordingly, other embodiments are within the scope of the following claims.

What is claimed is:

1. A method of determining connectivity of a pair of electroacoustic transducers comprising a higher-frequency transducer and a lower-frequency transducer which are connected in parallel on an output line of an amplifier, the method comprising:

causing the amplifier to apply a first test signal on the output line at a first test frequency where the impedance of the two transducers in parallel is less than the impedance of the higher-frequency transducer alone, observing whether a first clip detection signal is received from the amplifier, and if the first clip detection signal is not received from the amplifier in response to the first test signal, outputting a first error indication and stopping;

otherwise, if the first clip detection signal is received from the amplifier in response to the first test signal, continuing by causing the amplifier to apply a second test signal on the output line at a second test frequency where the impedance of the two transducers in parallel is less than the impedance of the lower-frequency transducer alone, observing whether a second clip detection signal is received from the amplifier, and if the second clip detection signal is not received from the amplifier in response to the second test signal, outputting a second error indication;

otherwise, if the second clip detection signal is received from the amplifier in response to the second test signal, continuing by causing the amplifier to apply a third test signal on the output line at a third test frequency where the impedance of the two transducers in parallel is higher if both transducers are operational than if the higher-frequency transducer is internally short-circuited, observing whether a third clip detection signal is received from the amplifier, and if the third clip detection signal is received from the amplifier in response to the third test signal, outputting a third error indication.

2. The method of claim 1, wherein the first test signal is output at a level sufficient to cause the amplifier to clip at the first test frequency if the lower-frequency transducer is connected to the output line.

3. The method of claim 1, wherein the second test signal is output at a level sufficient to cause the amplifier to clip at the second test frequency if the higher-frequency transducer is connected to the output line.

4. The method of claim 1, wherein the third test signal is output at a level sufficient to cause the amplifier to clip at the third test frequency if the higher-frequency transducer is not internally short-circuited, but not sufficient to cause the amplifier to clip at the third test frequency if both transducers are operational.

5. The method of claim 4, wherein the third test frequency is the same as the second test frequency, and the level of the third test signal is different from a level of the second test signal.

6. The method of claim 1, wherein outputting the first error indication and outputting the second error indication both comprise the providing a generic error signal.

7. The method of claim 1, wherein outputting the first error indication, outputting the second error indication, and outputting the third error indication all comprise the providing a generic error signal.

8. An audio system capable of determining connectivity of a pair of electroacoustic transducers comprising a higher-frequency transducer and a lower-frequency transducer which are connected in parallel on an output line of the audio system, the audio system comprising:

an amplifier circuit including a clip-detection circuit and configured to provide amplified signals to the output line;

a controller coupled to the amplifier circuit and configured to:

cause the amplifier circuit to apply a first test signal on the output line at a first test frequency where the impedance of the two transducers in parallel is less than the impedance of the higher-frequency transducer alone, determine whether a first clip detection signal was generated by the amplifier circuit, if a clip detection signal is not generated by the amplifier circuit in response to the first test signal, output a first error indication and stop, if a clip detection signal is generated by the amplifier circuit in response to the first test signal, cause the amplifier circuit to apply a second test signal on the output line at a second test frequency where the impedance of the two transducers in parallel is less than the impedance of the lower-frequency transducer alone, determine whether a second clip detection signal was generated by the amplifier circuit, if a second clip detection signal is not generated by the amplifier circuit in response to the second test signal, output a second error indication, if the second clip detection signal is generated by the amplifier circuit in response to the second test signal, cause the amplifier circuit to apply a third test signal on the output line at a third test frequency where the impedance of the two transducers in parallel is higher if both transducers are operational than if the higher-frequency transducer is internally short-circuited, determine whether a third clip detection signal is received from the amplifier, and if the third clip detection signal is received from the amplifier in response to the third test signal, output a third error indication.

9. The audio system of claim 8, further comprising a memory storing frequencies and amplitudes for the test signals, the memory storing the value of the first test frequency and a value for the amplitude of the first test signal that is sufficient to cause the amplifier circuit to clip at the first test frequency if the lower-frequency transducer is connected to the output line.

10. The audio system of claim 8, further comprising a memory storing frequencies and amplitudes for the test signals, the memory storing the value of the second test frequency and a value for the amplitude of the second test signal that is sufficient to cause the amplifier to clip at the second test frequency if the higher-frequency transducer is connected to the output line.

11. The audio system of claim 8, further comprising a memory storing frequencies and amplitudes for the test signals, the memory storing the value of the third test frequency and a value for the amplitude of the third test signal that is sufficient to cause the amplifier to clip at the third test frequency if the higher-frequency transducer is not internally short-circuited, but not sufficient to cause the amplifier to clip at the third test frequency if both transducers are operational.

12. The audio system of claim 11, wherein the third test frequency is the same as the second test frequency, and the level of the third test signal is different from a level of the second test signal.

13. The audio system of claim 8, wherein outputting the first error indication and outputting the second error indication both comprise the providing a generic error signal.

14. The audio system of claim 8, wherein outputting the first error indication, outputting the second error indication, and outputting the third error indication all comprise the providing a generic error signal.

* * * * *